US008950447B2

(12) United States Patent
De Rosa et al.

(10) Patent No.: US 8,950,447 B2
(45) Date of Patent: Feb. 10, 2015

(54) DISPENSING DEVICE INCLUDING A MOVABLE SPRAY HEAD AND A STATIONARY BASE AS WELL AS A MINIATURE ELECTRIC PUMP

(75) Inventors: Daniel De Rosa, Louviers (FR); Bruno Lablaine, Thivars (FR)

(73) Assignees: Maitrise et Innovation, Val de Rueil (FR); ABN Concept, Chartres (FR)

( * ) Notice: Subject to any disclaimer, the term of this patent is extended or adjusted under 35 U.S.C. 154(b) by 544 days.

(21) Appl. No.: 13/393,990

(22) PCT Filed: Sep. 6, 2010

(86) PCT No.: PCT/EP2010/063028

§ 371 (c)(1),
(2), (4) Date: Mar. 2, 2012

(87) PCT Pub. No.: WO2011/026969

PCT Pub. Date: Mar. 10, 2011

(65) Prior Publication Data

US 2012/0158193 A1 Jun. 21, 2012

(30) Foreign Application Priority Data

Sep. 7, 2009 (FR) ..... 09 56060

(51) Int. Cl.
*B67C 3/02* (2006.01)
*B05B 9/04* (2006.01)
(Continued)

(52) U.S. Cl.
CPC ..... *B05B 9/0403* (2013.01); *A47K 5/1217* (2013.01); *B05B 11/0037* (2013.01); *B05B 11/0056* (2013.01); *B05B 9/0426* (2013.01); *B05B 9/043* (2013.01); *B05B 9/0861* (2013.01)
USPC ..... 141/113; 141/67; 141/285; 141/380; 215/2

(58) Field of Classification Search
CPC ..... A47K 5/1217; B05B 11/0037; B05B 11/0056; B05B 9/0403; B05B 9/0426; B05B 9/043; B05B 9/0861
USPC ..... 141/67, 113, 285, 290, 330, 363–366, 141/380; 215/2
See application file for complete search history.

(56) References Cited

U.S. PATENT DOCUMENTS 4,197,884 A * 4/1980 Maran ..... 141/383
4,583,346 A * 4/1986 Kameda ..... 53/431
(Continued)

FOREIGN PATENT DOCUMENTS

WO 03/010083 A1 2/2003

OTHER PUBLICATIONS

International Search Report, dated Jan. 20, 2011, from corresponding PCT application.

*Primary Examiner* — Timothy L Maust
(74) *Attorney, Agent, or Firm* — Young & Thompson

(57) ABSTRACT

The invention relates to a packaging and dispensing device for a liquid or semi-liquid product, including: a movable spray head including at least one container supplying an outlet member; and at least one stationary base including a second container which can be connected to the above-mentioned first container via coupling element so that the product can be transferred from the second container in the base to the first container in the movable spray head in order for at least the product in the movable spray head to be refilled. The invention is characterized in that a miniature electric pump, known as a transfer pump, powered by an electrical power supply element and controlled by a control element, is disposed between the first and second containers to allow the product to be conveyed through the coupling element.

32 Claims, 11 Drawing Sheets

(51) Int. Cl.

| | |
|---|---|
| ***A47K 5/12*** | (2006.01) |
| ***B05B 11/00*** | (2006.01) |
| *B05B 9/043* | (2006.01) |
| *B05B 9/08* | (2006.01) |

(56) References Cited

U.S. PATENT DOCUMENTS 4,865,088 A * 9/1989 Stearns ..... 141/5
5,115,842 A * 5/1992 Crafts et al. ..... 141/286
5,343,904 A * 9/1994 Kaeser ..... 141/20
5,411,183 A * 5/1995 Hildebrandt ..... 222/399
5,462,099 A * 10/1995 Demarest et al. ..... 141/3
5,474,112 A * 12/1995 Carola ..... 141/7
5,623,974 A * 4/1997 Losenno et al. ..... 141/20
5,645,113 A * 7/1997 Humm et al. ..... 141/3
5,746,259 A * 5/1998 Noble, III ..... 141/92
7,207,360 B2 * 4/2007 Vargas ..... 141/322

* cited by examiner

DISPENSING DEVICE INCLUDING A MOVABLE SPRAY HEAD AND A STATIONARY BASE AS WELL AS A MINIATURE ELECTRIC PUMP

The invention relates to a packaging and dispensing device for a liquid or semiliquid product.

The invention relates more particularly to a packaging and dispensing device for a liquid or semiliquid product comprising a movable spray head comprising at least one first reservoir feeding an outlet member, and at least one fixed base, comprising a second reservoir, which can be connected to the first reservoir of the movable spray head via coupling means to allow product to be transferred from the second reservoir of the base to the first reservoir of the movable spray head in order at least to allow said movable spray head to be refilled with product.

Numerous examples of devices of this type are known.

In most of the devices of this type, the second reservoir is subjected to the pressure of a pressurized propellant gas and a valve system is interposed between the second reservoir and the first reservoir. The coupling of the movable spray head to the fixed base allows product to be transferred.

This design has the disadvantage of allowing the device to operate only when some gas remains in the second reservoir. It becomes impossible to fill the first reservoir when the supply of gas in the second reservoir has been exhausted.

Moreover, the use of such a device is restricted to liquid products, and cannot be applied to creamy products because the propellant gas is unable to subject a creamy product to a pressure high enough to expel it.

The invention redresses this disadvantage by providing a device of the type described hereinabove, comprising a miniature electrical transfer pump interposed between the second reservoir and the first reservoir to refill the removable spray head when it is coupled to the fixed base.

To this end, the invention proposes a device of the type described hereinabove, characterized in that a miniature electric pump, known as the transfer pump, powered by an electrical power supply means and controlled by control means is interposed between the first and second reservoirs to allow product to be conveyed through the coupling means.

According to other features of the invention:

the electric transfer pump is housed in a first casing of the movable spray head, the transfer pump is housed in a second casing of the fixed base, the coupling means comprise complementary two-way coupling elements, said ways comprising on the one hand a first way which is capable of connecting to the first reservoir a part of the second reservoir which is positioned below a second associated product level for the second reservoir and, on the other hand, a second way which is capable of connecting to the second reservoir a duct known as the overflow and/or vent duct, which opens above a first associated product level for the first reservoir, the coupling elements are able to move between a closed first configuration associated with the removal of the movable spray head, in which configuration the two ways are simultaneously closed, and an open second configuration associated with the coupling of the movable spray head and of the base, in which configuration the two ways are simultaneously open, each way can be selectively opened or closed by associated electrically operated valves, the coupling elements comprise:

a female member, borne by the movable spray head, and into an internal bore of which there opens at least one radial end of a first duct of the spray head, associated with the first way, which is connected to the first reservoir and a radial end of a second duct of the spray head, associated with the second, overflow, way, which is connected to the first reservoir above the first associated level for the first reservoir, said female member comprising at least one introductory opening communicating with its bore, a substantially cylindrical intermediate spool which is slideably mounted and is elastically returned by a return spring in the bore of the female member, said spool being able to move between a rest position to which it is returned elastically in the bore of the female member and in which it stops off the ends of the first and second ducts of the spray head, and a coupling position in which the spool is urged against the action of the return spring to uncover the ends of the first and second ducts of the spray head, a substantially cylindrical male member of a diameter at most equal to that of the introductory opening, through which there passes a first base duct which is connected to the second reservoir below a second associated level of the second reservoir and a second base duct which is connected to the second reservoir, the ends of which open radially at the periphery of said male member, said male member being able to be introduced into the opening of the female member in order to urge the spool against the action of the return spring in order to uncover the ends of the first and second ducts of the spray head opening into the bore and then in order to make the radial ends of the first and second base ducts open on to the radial ends of the first and second ducts of the spray head in order to open the two ways, the female member has the shape of a tubular sleeve which comprises:

a first internal portion of high diameter in which the tubular spool is elastically returned by a return spring which is housed in the spool and which bears against a transverse end wall of the sleeve, a second internal portion of smaller diameter, which with the first portion delimits a shoulder face against which an annular flange of the tubular spool is intended to abut, the coupling elements comprise:

a female member, borne by the movable spray head, into an internal bore of which there open at least a radial end of a first duct of the spray head, associated with the first way, which is connected to the first reservoir and a radial end of a second duct of the spray head, associated with the second, overflow, way, which is connected to the first reservoir above the first associated level for the first reservoir, said female member comprising at least one introductory opening communicating with its bore, a substantially cylindrical intermediate spool which is slideably mounted and elastically returned in the bore of the female member, said spool having, passing substantially longitudinally through it, first and second intermediate ducts each having ends known as internal ends, opening radially at one end of the spool into the internal bore of the female member, and external ends opening axially at the opposite end of the spool into a free transverse face of said spool, said spool being able to move between a rest position, to which it is elastically returned in the bore of the female member, in which position it stops off the radial ends of the first and second ducts of the spray head, and a coupling position in which the spool is urged against the action of the return spring in order to uncover the radial ends of the first and second ducts of the spray head and to allow the radial internal ends of the first and second intermediate ducts to coincide with the radial ends of the first and second ducts of the spray head, a substantially cylindrical male member of a diameter at most equal to that of the introductory opening, through which there passes a first axial base duct which is connected to the second reservoir below a second associated level for the second reservoir and a second axial base duct which is connected to the second reservoir, the axial ends of which open into a free transverse face of said male member, said male member being able to be introduced into the opening of the female member in such a way that the transverse face of the male member acts upon the transverse face of the spool in order to urge the spool against the action of the return spring and, at the same time, in order to cause the ends of the first and second base ducts to open on to the external ends of the first and second ducts of the spool in order to open the two ways, the female member has the form of a tubular sleeve which comprises:

a first internal portion of small diameter, in which a first portion of the spool comprising the internal ends of the first and second intermediate ducts is slideably mounted, a second internal portion of high diameter in which an annular flange of the tubular spool is elastically returned by a return spring which is housed around the spool and which bears against a shoulder face which is delimited by the first and second internal portions of the sleeve, a third internal portion of small diameter, which with the second portion delimits a shoulder face against which the annular flange of the tubular spool is intended to abut, the sleeve forming the female member extends into the first reservoir, and the first internal portion comprises a radial drilling which opens into said first reservoir or alternatively which communicates with the pump connected to the reservoir, and which constitutes the first duct of the spray head associated with the first way, and an internal axial counterbore communicating with a drilling which is formed in a transverse end wall of the sleeve and which communicates with a tube opening above the first associated level for the first reservoir, to form the second duct of the spray head, associated with the second, overflow, way, the fixed base comprises a housing that complements at least part of the spray head, the complementary two-way coupling elements being interposed between a wall of the spray head and the end wall of the housing of the fixed base, the coupling elements comprise:

a female member, borne by an upper transverse wall of the movable spray head, and into a substantially vertical internal bore of which there open at least one radial end of a first duct of the spray head, associated with the first way, which is connected to the first reservoir and an axial end of a second duct of the spray head, associated with the second, vent, way, which is connected to the first reservoir above the first associated level for the first reservoir and one end of a third duct of the spray head which is associated with the second, vent, way and which is in communication with the open air, said female member comprising at least one introductory opening communicating with its bore, a substantially cylindrical intermediate spool which is slideably mounted and elastically returned in the bore of the female member, said spool having, passing substantially longitudinally through it, a first intermediate duct having an end, known as the internal end, opening radially at one end of the spool into the internal bore of the female member, and an end known as the external end opening radially at the opposite end of the spool into a free transverse face of said spool, said spool having, passing substantially longitudinally through it, a second intermediate duct comprising an end, known as the internal end, which opens axially at one end of the spool into the internal bore of the female member and which can be stopped off by a float housed in the bore of the female member, and a so-called intermediate end opening radially into an intermediate part of said spool, said spool being able to move between a rest position to which it is elastically returned in the bore of the female member by a return spring and in which it stops off the internal end of the first duct of the spray head and the end of the third duct of the spray head associated with the second, vent, way and a coupling position in which the spool is urged against the action of the return spring to allow the internal end of the first intermediate duct and the intermediate end of the second intermediate duct to coincide with the ends of the first and third ducts of the spray head, a substantially cylindrical male member of a diameter at most equal to that of the introductory opening, through which there passes an axial base duct which is connected to the second reservoir below a second associated level for the second reservoir, the axial end of which opens into a free transverse face of said male member, said male member being able to be introduced into the opening of the female member so that the transverse face of the male member acts upon the transverse face of the spool in order to urge the spool against the action of the return spring and at the same time cause the end of the first base duct to open on to the external end of the first duct of the spool in order to open the two ways, the female member comprises:

an internal sleeve in which the tubular spool is returned elastically by a return spring which bears against a transverse end wall of the female member and in which the float is housed coaxially with said spring, an external sleeve, coaxial with the internal sleeve, the counterbores of which delimit with the internal sleeve the first and third ducts of the spray head and which comprises the transverse end wall of the female member, a lid which with the internal and external sleeves delimits a shoulder face against which a shoulder face of the tubular spool is intended to abut and which comprises a drilling forming the introductory opening intended to allow the passage of a reduced-diameter second portion of the spool the free end of which constitutes the transverse face of the spool on which the transverse face of the male member can act, at least part of the internal and external sleeves extends into the first reservoir, said part comprising a radial drilling which opens into said first reservoir or alternatively which communicates with the pump connected to the reservoir and which constitutes the first duct of the spray head associated with the first way, and said part comprising an axial drilling which is formed in a transverse end wall of the external sleeve and which communicates with the first reservoir to form the second duct of the spray head, associated with the second, vent, way, the female member is borne by a horizontal upper wall of the movable spray head, the spray head comprises a spray pump housed in a neck of the first reservoir and the female member is housed in said neck in a support that is common to both the pump and the female member, the transfer pump is a miniature pump of piezoelectric type, the electrical power supply means comprises a cell, notably a miniature cell of the lithium cell type, the electric power supply means comprises an accumulator battery that can be recharged by means of a source of electrical power, the electric power supply means is autonomous and notably comprises a photovoltaic panel or alternatively a manual generator of electrical current of the dynamo type, the accumulator battery can be connected to an electrical network directly or via a transformer, notably to a domestic AC mains network via a plug and/or a dedicated base station, or alternatively can be connected to a motor vehicle on-board DC electric network via an outlet of the cigarette lighter type or alternatively to a personal computer serial peripheral DC power supply circuit via a so-called "USB" serial connector, the control means comprises a switch that controls the electrical power supply means, the control means comprises an electronic circuit that forms a switch, the triggering of the electronic circuit that forms a switch is brought about by the stopping-off of a photoelectric cell, the triggering of the electronic circuit that forms a switch is brought about by the coupling of the complementary two-way coupling elements, the spray head or alternatively the base comprises a casing housing the miniature transfer pump, an electrical power supply means for said pump, and a means of controlling said pump, the casing consists of a cap fitted over the associated reservoir, the pump is borne by an intermediate element secured to the casing, the pump is fixed to an internal wall of the casing, the miniature pump of piezoelectric type comprises at least one variable-volume chamber to which the product is admitted via a first membrane that forms a one-way valve and from which the product is ejected via a second membrane that forms a one-way valve, the variable-volume chamber comprising at least one fixed wall and one moving membrane capable of being moved by a piezoelectric actuator in order to cause the volume of the chamber to vary, the movable spray head comprises a miniature electric spray pump, notably of piezoelectric type, interposed between the first reservoir and the outlet member, which is powered by an electrical power supply means for the movable spray head and which is controlled via control means, the electrical power supply means for the spray pump comprises a rechargeable accumulator battery which can be connected via the coupling means to the source of electrical power used for recharging the rechargeable accumulator battery of the base.

Further features and advantages of the invention will become apparent from reading the detailed description which follows, for an understanding of which reference will be made to the attached drawings in which.

Figure 5A:
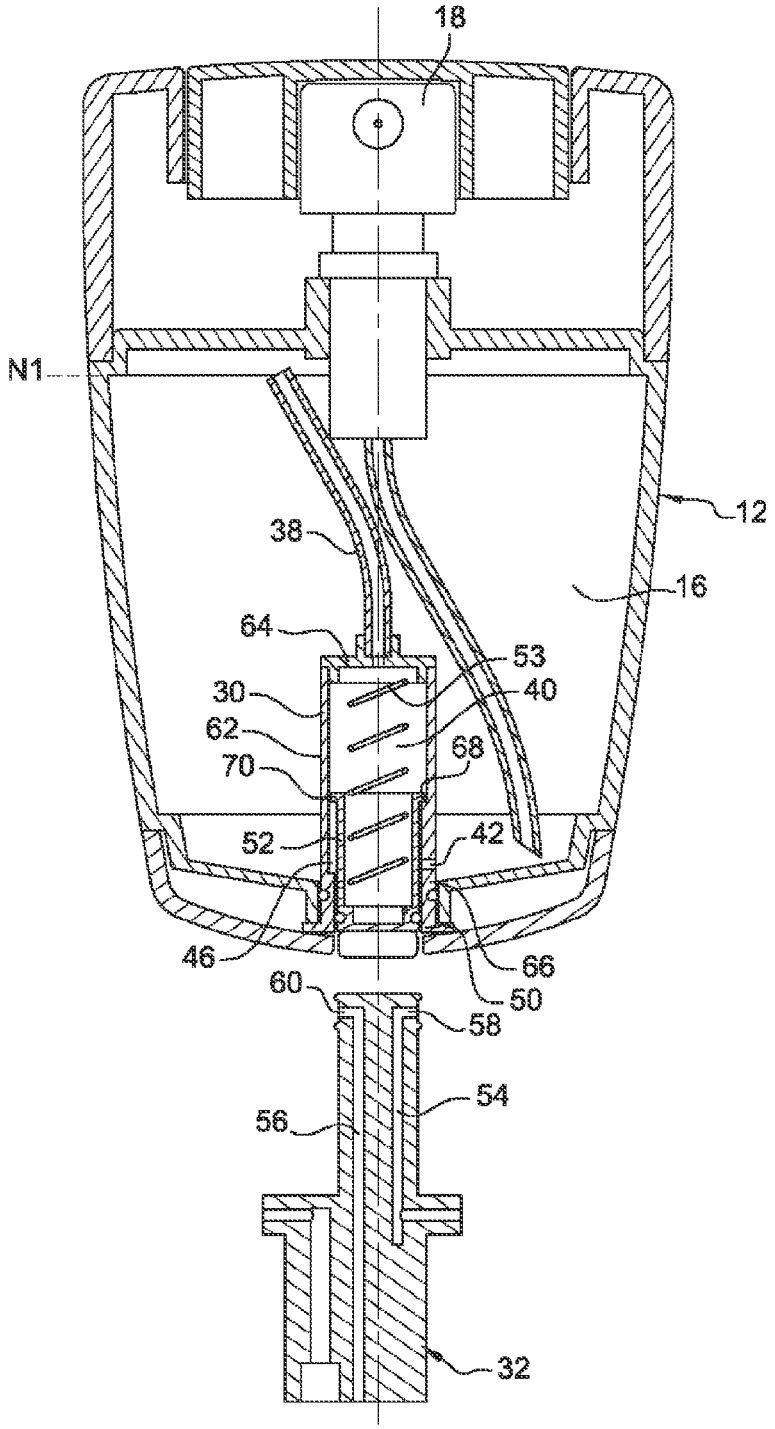
Figure 5B:
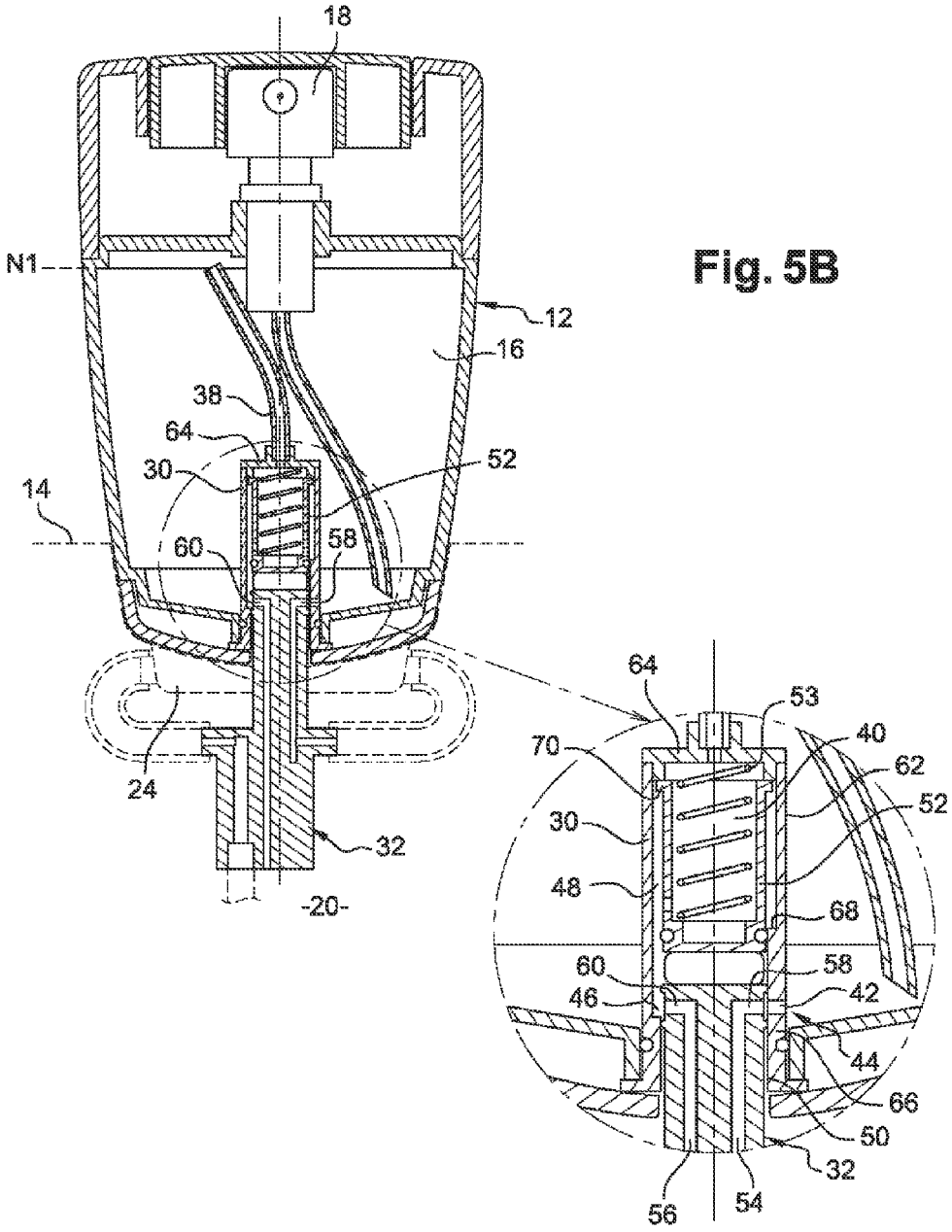
Figure 6A:
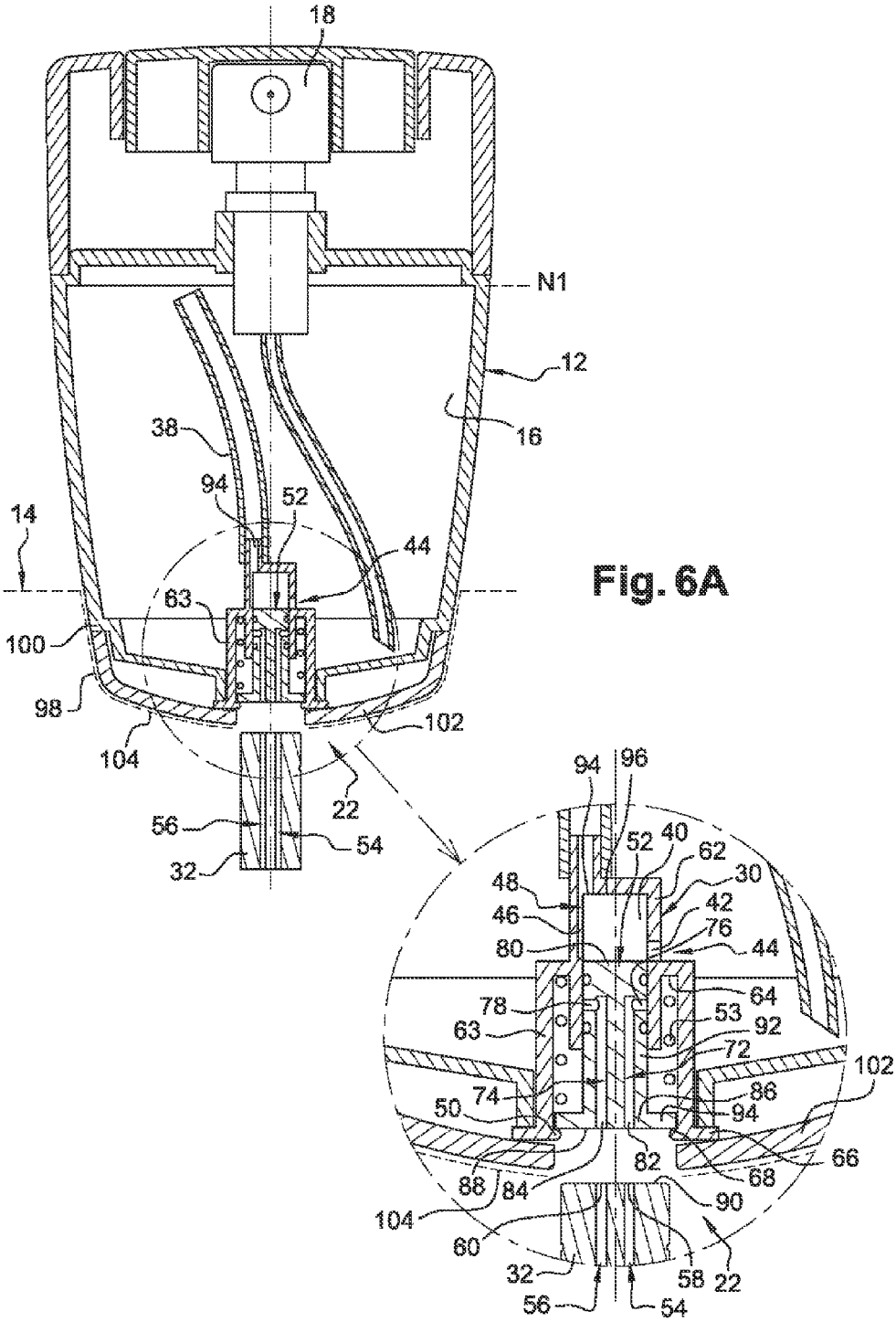
Figure 6B:
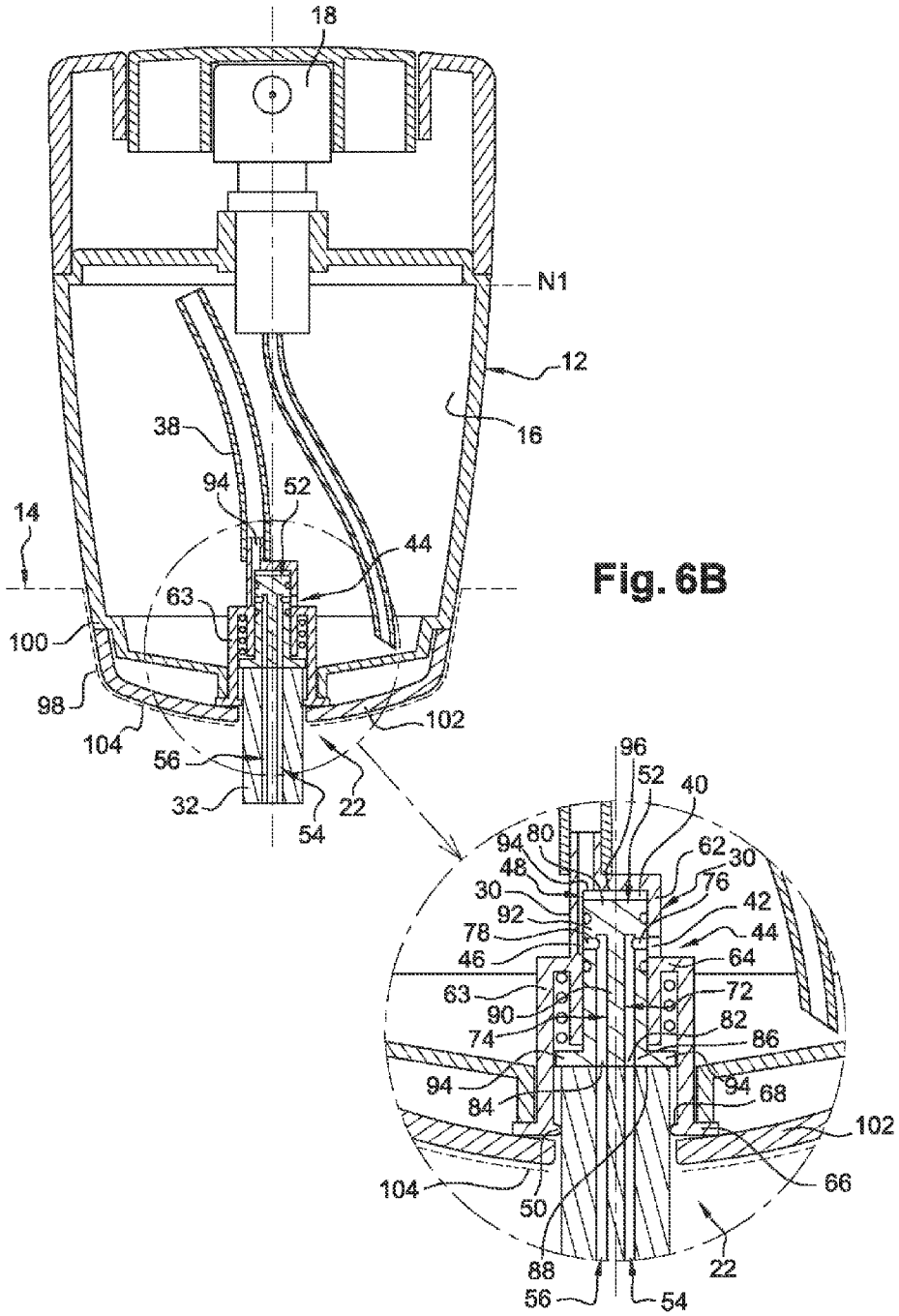
Figure 8:
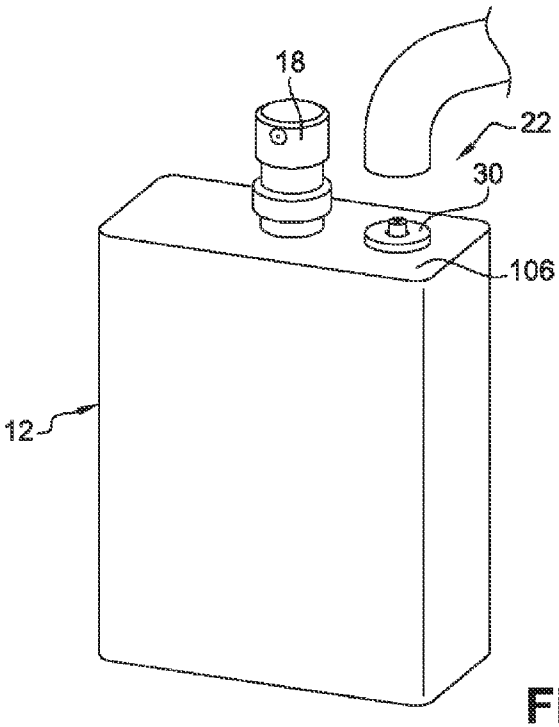
Figure 7:
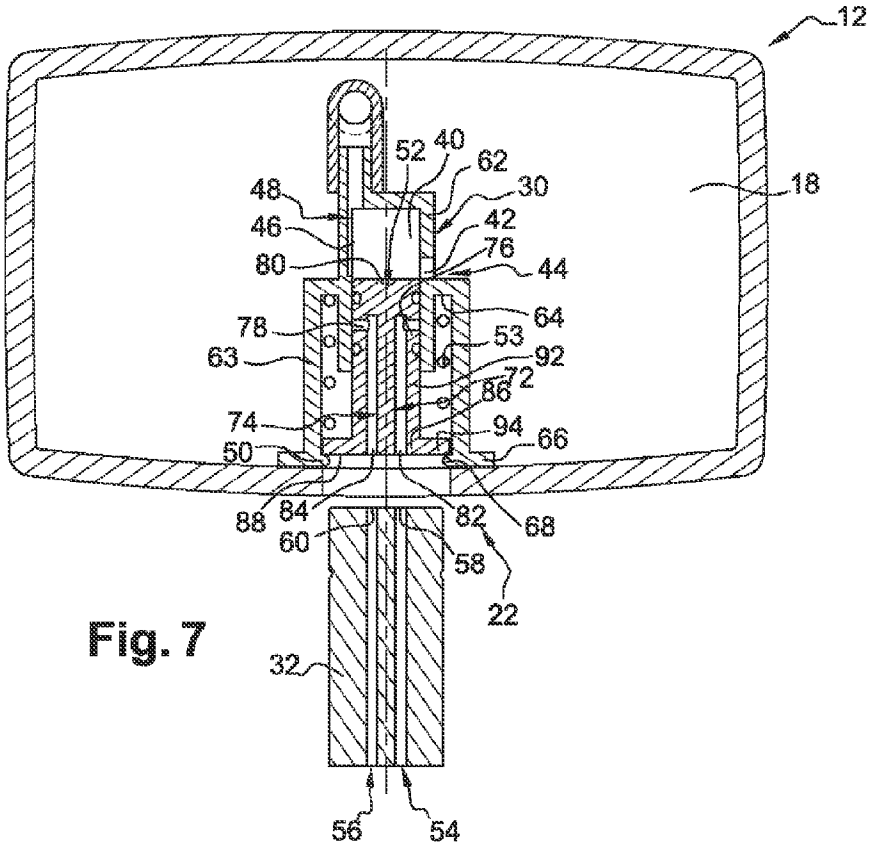
Figure 9A:
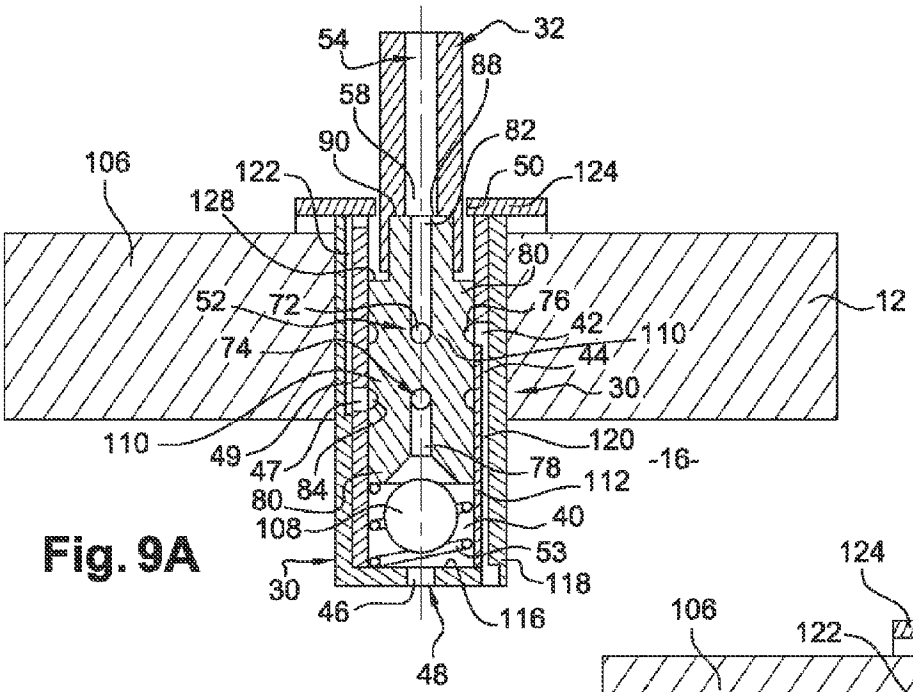
Figure 9B:
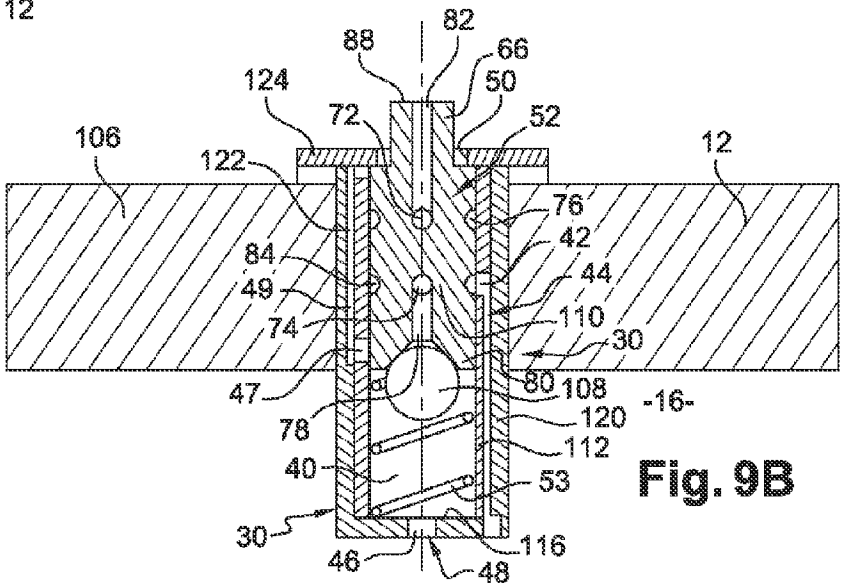
Figure 10A:
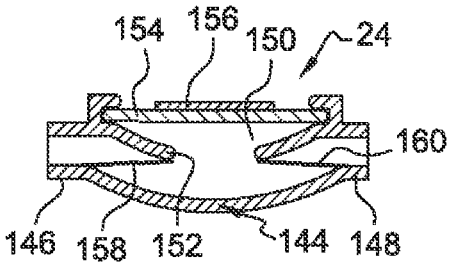
Figure 10B:
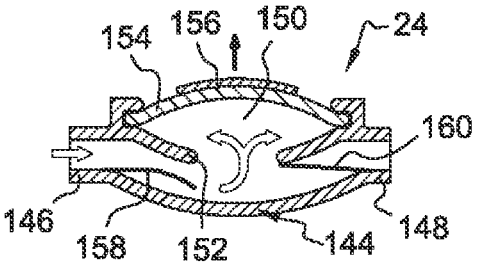
Figure 10C:
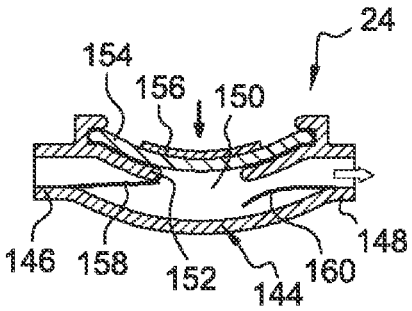

FIGS. 5A and 5B depict a first embodiment of the coupling means associated with the first or second embodiments of the device according to the invention, these being depicted respectively in a rest position and in a filling position, FIGS. 6A and 6B depict a second embodiment of the coupling means associated with the first or second embodiments of the device according to the invention, these being depicted respectively in a rest position and in a filling position, FIG. 7 depicts a fifth embodiment of a device according to the invention, depicted in a roaming position and comprising coupling means in the rest position, FIG. 8 is a perspective view of the fourth embodiment of a device according to the invention, depicted in its position known as the roaming position, FIGS. 9A and 9B depict a third embodiment of the coupling means associated with the first or second embodiments of the device according to the invention, these being depicted respectively in a rest position and in a filling position, FIGS. 10A to 10C are schematic views in cross section of a pump used in the invention depicted in succession in the position of rest, intake and delivery of liquid or semiliquid product.

In the description that follows, identical reference numerals denote parts that are identical or perform similar functions.

FIGS. 1A to 4B depict a packaging and dispensing device 10 for a liquid or semiliquid product, comprising a movable spray head 12 and a fixed base 14.

In the known way, the device 10 comprises a movable spray head 12 which comprises at least one first reservoir 16 feeding an outlet member 18. The device 10 also comprises at least a fixed base 14 comprising a second reservoir 20, which can be connected to the first reservoir 16 of the movable spray head 12 by coupling means 22 to allow product to be transferred from the second reservoir 20 in the base 14 to the first reservoir 16 in the movable spray head 12 so as at least to allow said movable spray head 12 to be refilled with product.

The reservoir 20 of the fixed base 14 is thus intended to allow the reservoir 16 of the movable spray head 12 to be refilled.

However, it will be appreciated that the reservoir 20 of the fixed base 14 can itself likewise be refilled using a suitable device (not depicted).

Conventionally, in a device of this type, the second reservoir 20 is subjected to the pressure of a pressurized propellant gas and a valve system is interposed between the second reservoir 20 and the first reservoir 16. The coupling of the movable spray head 12 to the fixed base 14 allows product to be transferred.

This design has the disadvantage of allowing the device to work only when gas still remains in the second reservoir 20. It becomes impossible to fill the first reservoir 16 once the supply of gas in the second reservoir 20 has been exhausted.

Moreover, the use of such a device is limited to liquid products and cannot be applied to semiliquid or creamy products.

To redress this disadvantage, the invention proposes a device of the type described hereinabove, comprising a device 10 in which an electric pump 24 is used to transfer the product.

To this end, the invention proposes a device 10 of the type described hereinabove, characterized in that a miniature electric pump 24, known as the transfer pump, is interposed between the first and second reservoirs 16, 20 to convey product through the coupling means 22.

Figure 1B:
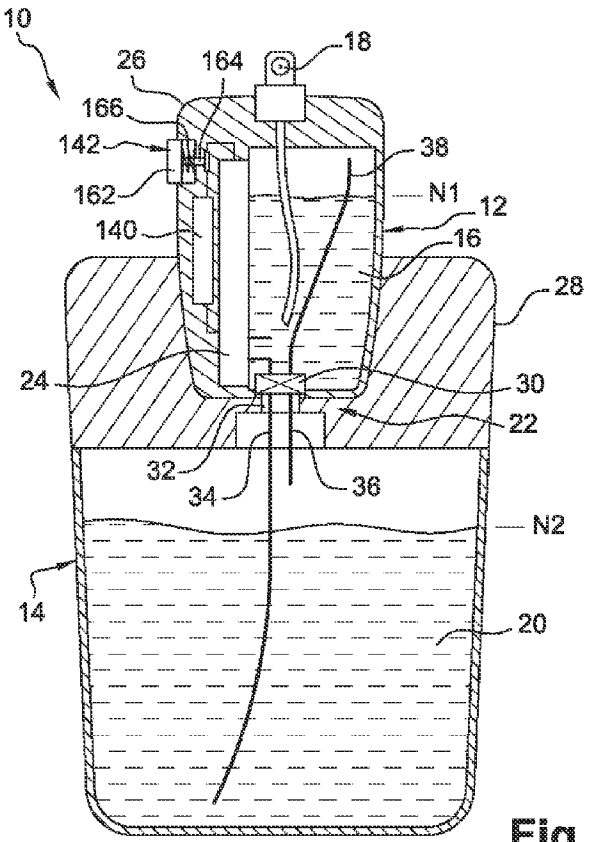
FIGS. 1A and 1B depict a first embodiment of a device according to the invention, depicted in positions known as the roaming and the coupled positions.
Figure 1A:
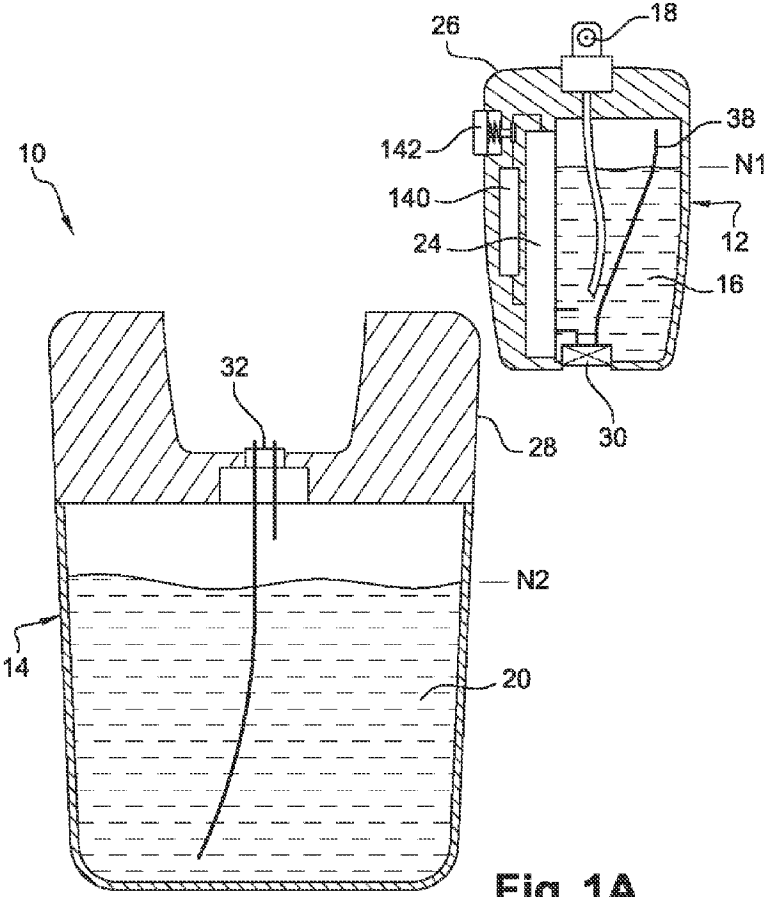
Figure 2B:
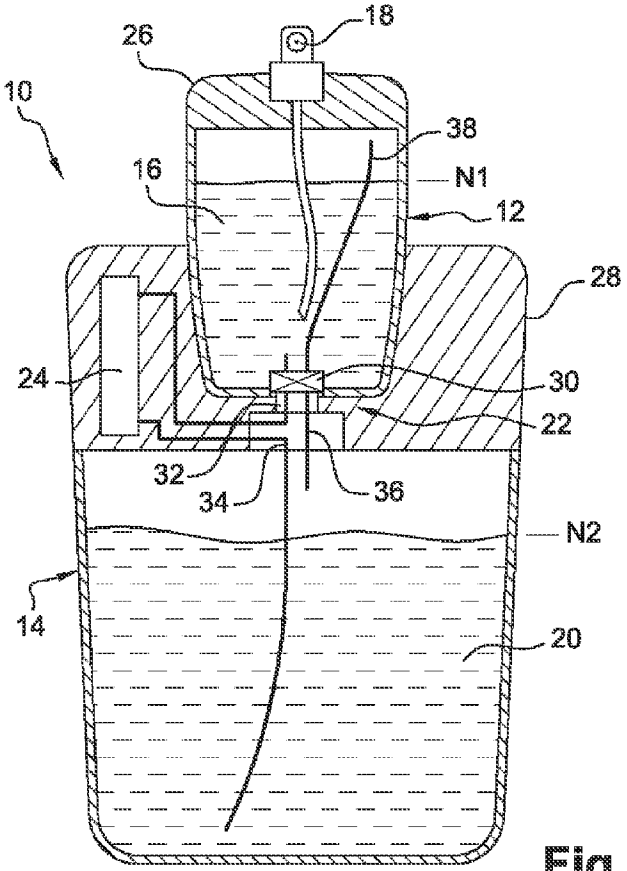
FIGS. 2A and 2B depict a second embodiment of a device according to the invention, depicted in positions known as the roaming and the coupled positions.
Figure 2A:
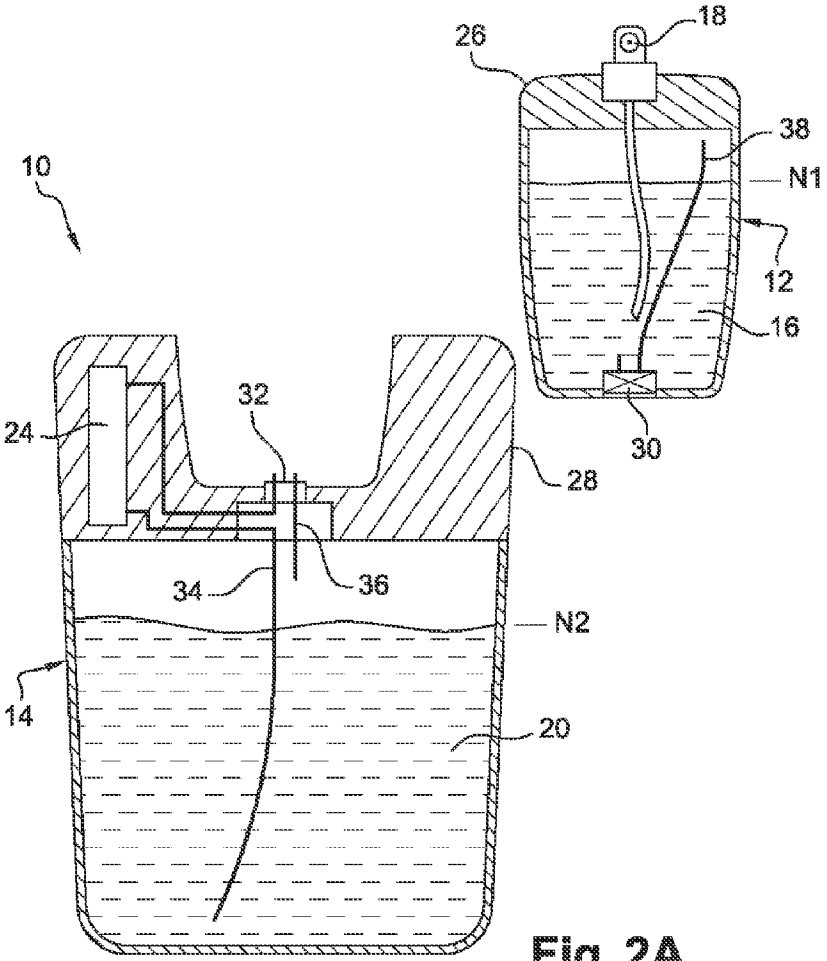

As FIGS. 1A and 1B illustrate, according to a first embodiment of the device 10, the pump is housed in a first casing 26 of the movable spray head 12.

As an alternative, as illustrated by FIGS. 2A to 4B, the transfer pump 24 is housed in a second casing 28 of the fixed base.

According to the invention, the coupling means 22 comprise complementary two-way 34, 36 coupling elements 30, 32, said ways 34, 36 comprising on the one hand a first way 34 which is capable of connecting to the first reservoir 16 a part of the second reservoir 20 which is positioned below a second associated product level "N2" for the second reservoir 20 and, on the other hand, a second way 36 which is capable of connecting to the second reservoir 20 a duct 38, known as the overflow and/or vent duct, which opens above a first associated product level "N1" for the first reservoir 16.

This configuration advantageously allows the first reservoir 16 to be filled from the second reservoir 20 without causing the first reservoir 16 to overflow.

This configuration also advantageously allows due consideration to be given to the expansion volume required by products containing alcohol which may experience significant expansion as a result of temperature.

Advantageously, the coupling elements 30, 32 are able to move between a closed first configuration associated with the removal of the movable spray head 12, in which configuration the two ways 34, 36 are simultaneously closed as depicted in FIGS. 1A, 2A, 3A and 4A, and an open second configuration associated with the coupling of the movable spray head 12 and of the base 14, in which configuration the two ways 34, 36 are simultaneously open, as depicted in FIGS. 1B, 2B, 3B and 4B.

According to one embodiment of the coupling means 22 which has not been depicted in the figures, each way 34, 36 can be selectively opened or closed by associated electrically operated valves.

For example, each way 34, 36 may comprise a pair of electrically operated valves, each of which is borne by one of the complementary coupling elements 30, 32. The coupling of the complementary coupling elements 30, 32 causes the two electrically operated valves of each way to open simultaneously, thus opening each way 34, 36.

However, the coupling means 22 are preferably mechanical.

A first embodiment of the coupling means 22 associated with the first or second embodiments of the device of FIGS. 1A, 1B, 2A, 2B has been depicted in FIG. 5A in a position of rest and in FIG. 5B in a filling position.

In this embodiment of the coupling means 22, said coupling means 22 comprise a female member 30, borne by the movable spray head 12, and into an internal bore 40 of which there opens at least one radial end 42 of a first duct 44 of the spray head 12, associated with the first way 34, which is connected to the first reservoir 16 and a radial end 46 of a second duct 48 of the spray head 12, associated with the second, overflow, way 36, which is connected to the first reservoir 16 above the first associated level "N1" for the first reservoir 16.

The female member 30 comprises at least one introductory opening 50 communicating with its bore 40.

The coupling elements 22 also comprise a substantially cylindrical intermediate spool 52 which is slideably mounted and is elastically returned by a return spring 53 in the bore 40 of the female member 30, said spool 52 being able to move between a rest position, depicted in FIG. 5A, to which it is returned elastically in the bore 40 of the female member 30 and in which it stops off the ends 42, 46 of the first and second ducts 44, 48 of the spray head 12, and a coupling position, depicted in FIG. 5B, in which the spool 52 is urged against the action of the return spring 53 to uncover the ends 42, 46 of the first and second ducts 44, 48 of the spray head 12.

The coupling elements 22 finally comprise a substantially cylindrical male member 32 of a diameter at most equal to that of the introductory opening 50, through which there passes a first base duct 54 which is connected to the second reservoir 20 below a second associated level "N2" for the second reservoir 20, depicted earlier in FIGS. 1A and 1B, and a second base duct 56 which is connected to the second reservoir 20, the respective ends 58, 60 of which open radially at the periphery of said male member 32, said male member 32 being able to be introduced into the opening 50 of the female member 30 in order to urge the spool 52 against the action of the return spring 53 in order to uncover the ends 42, 46 of the first and second ducts 44, 48 of the spray head 12 opening into the bore 50 and then in order to make the radial ends of the first and second base ducts 54, 56 open on to the radial ends 58, 60 of the first and second ducts 44, 48 of the spray head 12 in order to open the two ways 34, 36.

Any embodiment of the female member 30, of the intermediate spool 52 and of the male member 32 as previously described may be suitable for correct implementation of the invention.

However, for preference, the female member more particularly has the shape of a tubular sleeve 30 which comprises a first internal portion 62 of high diameter in which the tubular spool 52 is elastically returned by a return spring 53 which is housed in the spool 52 and which bears against a transverse end wall 64 of the sleeve 30, and a second internal portion 66 of smaller diameter, which with the first portion 62 delimits a shoulder face 68 against which an annular flange 70 of the tubular spool 52 is intended to abut.

A second embodiment of the coupling means 22 associated with the first or second embodiments of the device of FIGS. 1A, 1B, 2A, 2B and 7 has been depicted in FIG. 6A in a position of rest and in FIG. 6B in a filling position.

In this embodiment of the coupling means 22, said coupling means 22 comprise a female member 30, borne by the movable spray head 12, into an internal bore 40 of which there open at least a radial end 42 of a first duct 44 of the spray head 12, associated with the first way 34, which is connected to the first reservoir 16 and a radial end 46 of a second duct 48 of the spray head 12, associated with the second, overflow, way 36, which is connected to the first reservoir 16 above the first associated level "N1" for the first reservoir 16, said female member 30 comprising at least one introductory opening 50 communicating with its bore 40.

The coupling elements 22 also comprise a substantially cylindrical intermediate spool 52 which is slideably mounted and elastically returned in the bore 40 of the female member 30.

The spool 52 has, passing substantially longitudinally through it, first and second intermediate ducts 72, 74 each having ends 76, 78, known as internal ends, opening radially at one end 80 of the spool 52 into the internal bore 40 of the female member 30, and external ends 82, 84 opening axially at the opposite end 86 of the spool 52 into a free transverse face 88 of said spool 52.

The spool 52 is able to move between a rest position, depicted in FIGS. 6A and 7, to which it is elastically returned by a spring 53 in the bore 40 of the female member 30, in which position it stops off the radial ends 42, 46 of the first and second ducts 44, 48 of the spray head 12, and a coupling position, depicted in FIG. 6B, in which the spool 52 is urged against the action of the return spring 53 in order to uncover the radial ends 42, 46 of the first and second ducts 44, 48 of the spray head 12 and to allow the radial internal ends 76, 78 of the first and second intermediate ducts 72, 74 to coincide with the radial ends 42, 46 of the first and second ducts 44, 48 of the spray head 12.

The coupling elements 22 finally comprise a substantially cylindrical male member 32 of a diameter at most equal to that of the introductory opening 50, through which there passes a first axial base duct 54 which is connected to the second reservoir 20 below a second associated level "N2" for the second reservoir 20, depicted earlier in FIGS. 1A and 1B, and a second axial base duct 56 which is connected to the second reservoir 20, the respective axial ends 58, 60 of which open into a free transverse face 90 of said male member 32, said male member 32 being able to be introduced into the opening 50 of the female member 30 in such a way that the transverse face 90 of the male member 32 acts upon the transverse face 88 of the spool 52 in order to urge the spool 52 against the action of the return spring 53 and, at the same time, in order to cause the ends of the first and second base ducts 54, 56 to open on to the external ends 82, 84 of the first and second ducts 72, 74 of the spool 52 in order to open the two ways 34, 36.

Any embodiment of the female member 30, of the intermediate spool 52 and of the male member 32 as previously described may be suitable for correct implementation of the invention.

However, for preference, the female member has the form of a tubular sleeve 30 which comprises:

- a first internal portion 62 of small diameter, in which a first portion 92 of the spool 52 comprising the internal ends 76, 78 of the first and second intermediate ducts 72, 74 is slideably mounted,
- a second internal portion 63 of high diameter in which an annular flange 94 of the tubular spool 52 is elastically returned by a return spring 53 which is housed around the spool 52 and which bears against a shoulder face 64 which is delimited by the first and second internal portions 62, 63 of the sleeve,
- a third internal portion 66 of small diameter, which with the second portion 63 delimits a shoulder face 68 against which the annular flange 94 of the tubular spool 52 is intended to abut.

In each of these first and second embodiments of the coupling means 22 associated with the first or second embodiments of the device of FIGS. 1A, 1B, 2A, 2B and 7, the sleeve 30 forming the female member extends into the first reservoir 16.

According to the positioning of the pump 24 in the spray head 12 or in the base 14, the first internal portion 62 comprises a radial drilling 44 which opens directly into said first reservoir 16 or alternatively which communicates with the pump 24 connected to the reservoir 16, and which constitutes the first duct 44 of the spray head 12 associated with the first way 34.

The first internal portion 62 also comprises an internal axial counterbore forming the second duct 48 communicating with a drilling 94 which is formed in a transverse end wall 96 of the sleeve 30 and which communicates with a tube 38 opening above the first associated level "N1" for the first reservoir, to form the second duct 48 of the spray head, associated with the second, overflow, way 36.

Advantageously, in the first and second embodiments of the device 10 which has been depicted in FIGS. 1*a*, 2A, 2B and 2C, the fixed base 14 comprises a housing 98 that complements at least part 100 of the spray head 12. In addition, the complementary two-way coupling elements 30, 32 are interposed between a wall 102 of the part 100 of the spray head 12 and an end wall 104 of the housing 98 of the fixed base 14.

Thus, the female member 30 is borne by the wall 102 and the male member is borne by the end 104 of the housing 98.

Figure 3B:
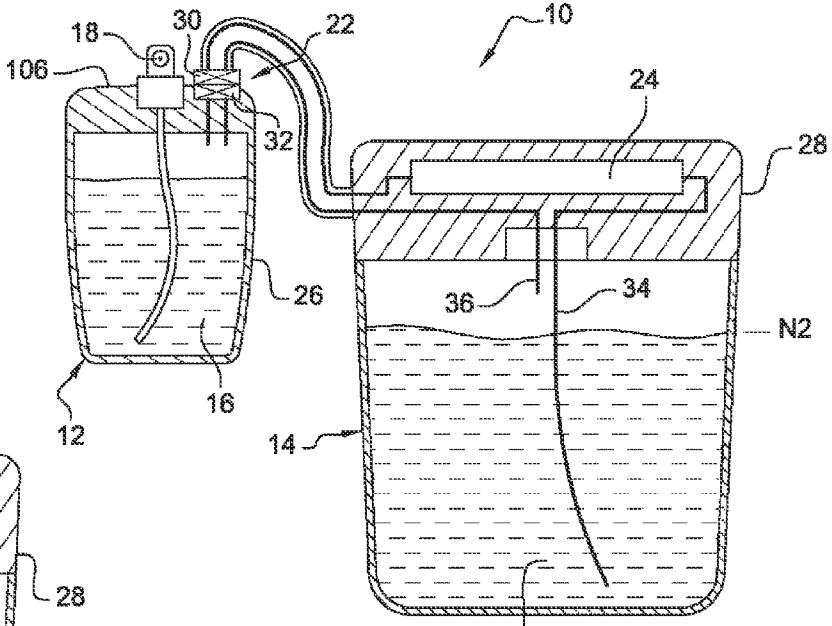
FIGS. 3A and 3B depict a third embodiment of a device according to the invention, depicted in positions known as the roaming and the coupled positions.
Figure 3A:
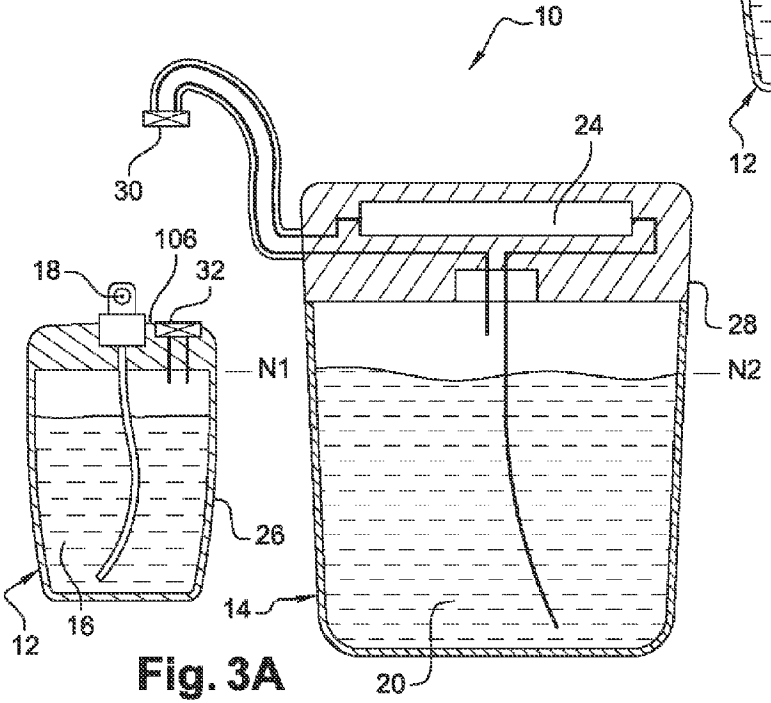

A third embodiment of the coupling means 22 associated with the third embodiment of the device of FIGS. 3A and 3B has been depicted in FIGS. 8, 9A and 9B in a position of rest and in FIG. 6B in a filling position.

In this embodiment of the coupling means 22, said coupling elements 22 comprise a female member 30, borne by an upper transverse wall 106 of the movable spray head 12, and into a substantially vertical internal bore 40 of which there open at least one radial end 42 of a first duct 44 of the spray head 12, associated with the first way 34, which is connected to the first reservoir 16 and an axial end 46 of a second duct 48 of the spray head 12, associated with the second, vent, way 36, which is connected to the first reservoir 16 above the first associated level for the first reservoir 16 and one end 47 of a third duct 49 of the spray head 12 which is associated with the second, vent, way 36 and which is in communication with the open air.

The female member 30 comprises at least one introductory opening 50 communicating with its bore 40.

The coupling elements 22 comprise a substantially cylindrical intermediate spool 52 which is slideably mounted and elastically returned in the bore 40 of the female member 30 by a spring 53.

The spool 52 has, passing substantially longitudinally through it, a first intermediate duct 72 having an end 76, known as the internal end, opening radially at one end 80 of the spool 52 into the internal bore 40 of the female member 30, and an end known as the external end 82 opening radially at the opposite end 86 of the spool 52 into a free transverse face 88 of said spool 52. The external end 82 notably opens into an annular groove formed at the periphery of the spool 52 which is cylindrical, and communicates internally to the spool 52 with the end 76.

The spool 52 has, passing substantially longitudinally through it, a second intermediate duct 74 comprising an end 78, known as the internal end, which opens axially at one end 80 of the spool 52 into the internal bore 40 of the female member and which can be stopped off by a float 108 housed in the bore 40 of the female member 30, and a so-called intermediate end 84 opening radially into an intermediate part 110 of said spool 52.

The intermediate end 84 notably opens into an annular groove formed at the periphery of the spool 52, and communicates internally to the spool 52 with the end 78.

The spool 52 is able to move between a rest position, depicted in FIG. 9A, to which it is elastically returned in the bore 40 of the female member 30 by the spring 53 and in which it stops off the internal end 42 of the first duct 44 of the spray head 12 associated with the first way 34 and the end 47 of the third duct 49 of the spray head associated with the second, vent, way 36 and a coupling position, depicted in FIG. 9B, in which the spool 52 is urged against the action of the return spring 53 to allow the internal end 76 of the first intermediate duct 72 and the intermediate end 84 of the second intermediate duct 74 to coincide with the ends of the first and third ducts 44, 49 of the spray head 12.

As illustrated in FIG. 9A, the coupling elements 22 finally comprise a substantially cylindrical male member 32 of a diameter at most equal to that of the introductory opening 50, through which there passes an axial base duct 54 which is connected to the second reservoir 20 below a second associated level for the second reservoir 20, the axial end 58 of which opens into a free transverse face 90 of said male member 32, said male member 32 being able to be introduced into the opening 50 of the female member 30 so that the transverse face 90 of the male member 32 acts upon the transverse face 88 of the spool 52 in order to urge the spool 52 against the action of the return spring 53 and at the same time cause the end 58 of the first base duct 54 to open on to the external end 82 of the first intermediate duct 72 of the spool 52 in order to open the two ways 34, 36.

As illustrated in FIG. 8, the female member 30 comprises an internal sleeve 112 in which the tubular spool 52 is returned elastically by a return spring 53 which bears against a transverse end wall 116 of the female member 30 and in which the float 108 is housed coaxially with said spring 53.

The female member 30 also comprises an external sleeve 118, coaxial with the internal sleeve 112, the counterbores 120, 122 of which delimit with the internal sleeve the first and third ducts 44, 49 of the spray head 12 and which comprises the end face 116.

The female member 30 finally comprises a lid 124 which with the internal and external sleeves 112, 118 delimits a shoulder face 126 against which a shoulder face 128 of the tubular spool 52 is intended to abut and which comprises a drilling 50 forming the introductory opening intended to allow the passage of a reduced-diameter second portion 66 of the spool the free end of which constitutes the transverse face 88 of the spool 52 on which the transverse face of the male member 90 can act.

For preference, at least part of the internal and external sleeves 112, 118 extends into the first reservoir 16, and this part comprises a radial drilling which opens into said first reservoir 16 or alternatively which communicates with the pump 24 connected to the reservoir 16 and which constitutes the first duct 44 of the spray head 12 associated with the first way 34.

This part also comprises an axial drilling which is formed in a transverse end wall 116 of the external sleeve 118 and which communicates with the first reservoir 16 to form the second duct 48 of the spray head 12, associated with the second, vent, way 36.

In this embodiment, the female member 30 is borne by a horizontal upper wall 106 of the movable spray head 12, as depicted in FIGS. 3A and 3B, 8 and 9A and 9B.

Figure 4B:
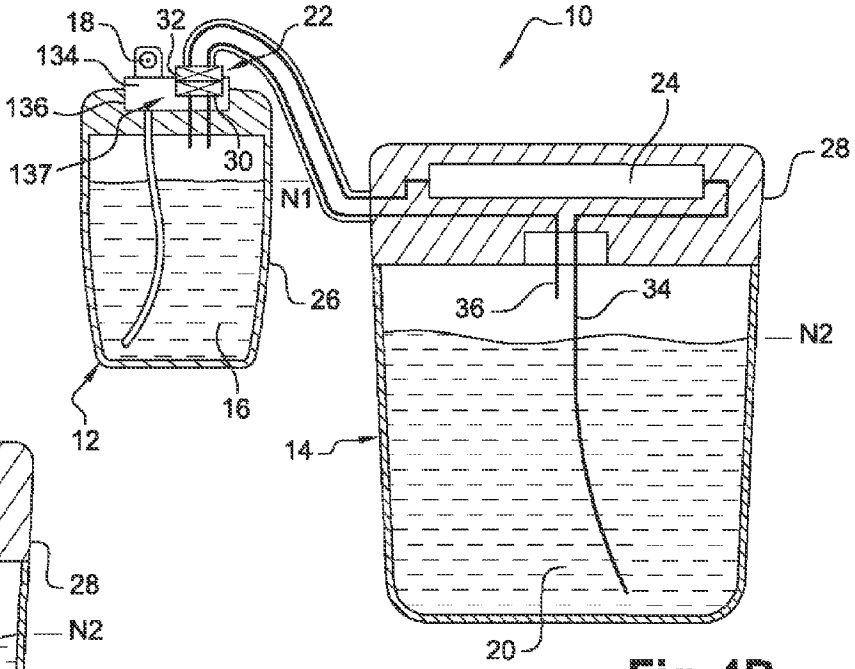
FIGS. 4A and 4B depict a fourth embodiment of a device according to the invention, depicted in positions known as the roaming and the coupled positions.
Figure 4A:
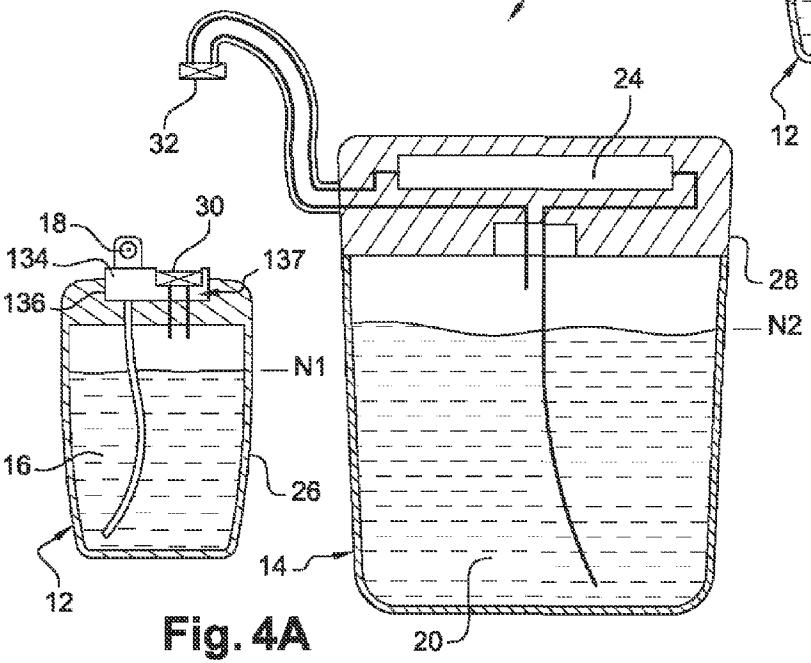

As an alternative, if the spray head comprises a spray pump 134 housed in a neck 136 of the first reservoir 16, the female member may advantageously likewise be housed in said neck 136 in a support 137 that is common to both the pump 134 and the female member, as depicted in FIGS. 4A and 4B.

The spray pump 134 may be mechanical or, as will be seen later on in this description, may also be an electric pump.

In the preferred embodiment of the invention, as depicted in detail in FIGS. 1A and 1B, the casing 26, 28 of the spray head 12 or alternatively the base 14, accommodates the miniature transfer pump 24, an electrical power supply means 140 for said pump, and a means 142 for controlling said pump.

Thus, it is the casing 26 of the spray head which accommodates these elements in the case of the first embodiment of the invention depicted in FIGS. 1A, 1B and it is the casing 28 of the base which accommodates these elements (not depicted) in the case of the second to fourth embodiments of the invention which have been depicted in FIGS. 2A to 4B.

It will be appreciated that this arrangement is not limiting of the invention and that the invention aims above all to combine into one and the same casing 26 or 28 the pump 24, the electrical power supply means 140 and the control means 142 in order to reduce the number of electrical contacts involved.

Nonetheless, the pump 24, its power supply means 140 and its control means could be allocated differently between the spray head and the base, the electrical connection then being made via the coupling means 22.

In the preferred embodiment of the invention, the pump 24 is a pump of piezoelectric type.

Such a piezoelectric pump has been depicted schematically in FIGS. 10A to 10C.

In the known way, the piezoelectric pump 24 comprises a casing 144 equipped with an inlet nozzle 146 and an outlet nozzle 148.

Inside the casing 144 there is a variable-volume chamber 150 which comprises at least one fixed wall 152 and one moving membrane 154 which can be moved by a piezoelectric actuator 156 in order to cause the volume of the chamber 150 to vary.

The product can be admitted to the variable-volume chamber 150 by a first membrane 158 that forms a one-way valve, and can be ejected from the chamber 150 by a second membrane 160 forming a one-way valve.

When the piezoelectric actuator 156 is subjected to an electric current of determined frequency, it is capable of moving to deform the moving membrane 154 into a first configuration, depicted in FIG. 10B, in which the volume of the variable-volume chamber 150 is increased, and in which the product can thus be admitted through the inlet nozzle 146 and the first valve-forming membrane 158.

The piezoelectric actuator 156 is also capable of being moved in such a way that the moving membrane 154 occupies a second configuration in which the variable-volume chamber 150 experiences a reduction in its volume, as illustrated in FIG. 10C. The product contained in the chamber 150 is therefore ejected through the second membrane 160 and the outlet nozzle 148.

Moreover, such a pump 24 may comprise one or more chambers 150, generally arranged in series.

For correct implementation of the invention, use will preferably be made of a commercially available piezoelectric pump, said pump preferably comprising two chambers 150 arranged in series and having the advantage of a small size and a low electrical power consumption.

Thus, such a pump may occupy a maximum of 30 millimeters of space for a weight of 2 grams with an electrical power consumption of less than 200 milliwatts.

It can produce a delivery of 6 milliliters per minute at 550 millibar pressure when subjected to a sinusoidal current at a frequency of 100 Hz.

Of course, it is also possible to use a single-chamber pump, likewise commercially available.

There are various conceivable arrangements for producing the means 140 of electrically powering the pump 24.

According to a first embodiment of the invention, the electrical power supply means 140 comprises a cell, for example a miniature cell, of the lithium cell type.

Such a type of cell is particularly suited to the device 10 according to the invention when the reservoir 20 of the base 14 is not designed to be refilled. In such a case, the life of the cell more or less corresponds to the total electrical power consumed by the pump 24 to transfer the entire contents of the reservoir 20 of the base 14 to the reservoir 16 of the spray head 12.

According to another embodiment of the electrical power supply means 140, as depicted in FIG. 1A, the electrical power supply means 140 may comprise an accumulator battery which is rechargeable from at least one source of electrical power (not depicted).

According to a first embodiment of the electrical power supply means 140, the latter may, as an alternative, comprise a photovoltaic panel (not depicted) which is preferably placed on the external surface of the spray head or of the base 14 so as to allow the accumulator battery 34 to be recharged when the device 10 is not being used.

The electrical power supply means 140 may also comprise a manual generator of current of the dynamo type (not depicted) which can be incorporated into the casing 26 or 28 of the spray head 12 or of the base 14 to allow the accumulator 140 to be recharged.

In this case, it must be understood that the casing 26 or 28 in question must be designed to incorporate a space (not depicted) to house the generator and a fold-out cranking handle or trigger (not depicted) for operating said generator in order to allow the accumulator 140 to be recharged.

According to a second embodiment, when the electrical power supply means is an accumulator 140, the latter is notably connected to an existing electrical network.

For example, the electrical network consists of a domestic AC mains supply network.

In this case, the rechargeable accumulator 140 of the device 10 can be recharged by connecting the rechargeable accumulator 140 to a transformer connected to said domestic electrical mains.

To this end, a socket (not depicted) may, for example, be provided on the surface of the casing 26 or 28 which accepts the accumulator. This socket will be intended to accept a plug collector of the transformer.

As an alternative, the electrical network may also be a motor vehicle DC on-board electrical network, the rechargeable accumulator 140 then being connected to a plug of the cigarette lighter type (not depicted) intended to be connected to the on-board electrical network of said motor vehicle.

Finally, the electrical network may also be a personal computer serial peripheral DC power supply circuit and in that case the device 10 may have what is known as a "USB" serial connector intended to be inserted into a corresponding USB port of a personal computer so that the rechargeable accumulator 140 can be recharged.

In the preferred embodiment of the invention, as depicted in FIGS. 1A, 1B, the control means 142 comprises a switch controlling the electrical power supply means 140.

This is notably a switch of the push-button type protruding from the surface of the casing 26 or 28.

The switch 142 comprises a push-button 162, mounted to slide on a spindle 164 and returned elastically by a spring 166. The button 162 is secured to a terminal capable of coming into contact with another terminal (not depicted) to close the power supply circuit of the pump 24.

As an alternative, the control means 142 may comprise an electronic circuit (not depicted) that forms a switch associated with a photoelectric cell arranged on the casing 28 of the base.

The cell may be placed on the external surface of the casing 28 so as to be stopped off when brushed by the hand of a user, or more effectively in the bottom 104 of the space 98 in the fixed base 14, as previously described.

The stopping-off of the cell 170 activates the electronic circuit which triggers the application of power to the pump 24.

As an alternative, the electronic circuit 168 may be associated with a contact that is "made" as the complementary two-way coupling elements 30, 32 are coupled. The coupling of these two elements 30, 32, combined with the resting of the spray head on the base, activates the electronic circuit 168 which triggers the application of power to the pump 24.

It will of course be appreciated that other configurations of the control means 142 are conceivable without limiting the scope of the invention, for example, voice control or proximity detection control which is of particular benefit in the case of a device used to package a cosmetic product that is to be applied to the skin, detection of the proximity of the user's skin then being able to initiate the dispensing of the product 14.

As was seen earlier, depending on whether the pump 24 is housed in the spray head or in the base, the casing 26, 28 of the spray head 12 or alternatively of the base 14 houses the miniature transfer pump 24, an electrical power supply means 140 for said pump, and a control means 142 for controlling said pump.

The casing 26 or 28 can therefore be a conventional casing housing the associated reservoir 16 or 20.

As an alternative (not depicted), the casing 26 or 28 may consist of a cap fitted over the reservoir 16 or 20.

In the simplest embodiment of the invention, the pump 24 is fixed to an internal wall of the casing 26, 28.

However, for preference, the pump 24 is borne by an intermediate element (not depicted) secured to the casing 26, 28. This element may also comprise the electrical power supply means 140 for said pump 24, and the control means 142 for controlling said pump, so that when the device 10 is being assembled, all of these elements can be mounted as a single entity inside the casing 26 or 28 that is intended to accept them.

Advantageously, according to an alternative form (not depicted) of the invention, the movable spray head 12 may likewise comprise a miniature electric spray pump, preferably a piezoelectric pump, which is interposed between the first reservoir 16 and the outlet member 18, which is powered by an electrical power supply means (not depicted) for the movable spray head, and which is controlled by an associated control means (not depicted).

This electric spray pump may be an independent pump intended only for spraying the product, or may simply consist of the transfer pump which, as FIGS. 1A and 1B associated with the first embodiment of the device 10 illustrate, is housed in the first casing 26 of the movable spray head 12. In such a case, the pump 24 performs both the transfer and spraying functions.

Similarly, it will be appreciated that, in the case of the second embodiment illustrated in FIGS. 2A to 4B, the transfer pump 24 which is housed in the second casing 28 of the fixed base may also perform a spray function, the casing 28 of the fixed base then likewise being equipped with an outlet member (not depicted) to allow the spray head and the base to be used independently.

It will be appreciated that, in this configuration, the electrical power supply means for the spray pump of the spray head 12 comprises a rechargeable accumulator battery which can be connected via the coupling means 30, 32 to the source of electrical power used to recharge the rechargeable accumulator battery 140 of the base 14.

The invention therefore makes it possible to offer, in a very simple way, a packaging device for a liquid or semiliquid product comprising a spray head 12 which, as desired, can either be placed on or removed from a base 14 for refilling/recharging it.

The invention claimed is:

1. A packaging and dispensing device (10) for a liquid or semi-liquid product comprising a movable spray head (12) comprising at least one first reservoir (16) feeding an outlet member (18), and at least one fixed base (14), comprising a second reservoir (20), which can be connected to the first reservoir (16) of the movable spray head (12) via coupling means (22) to allow product to be transferred from the second reservoir (20) of the base (14) to the first reservoir (16) of the movable spray head (12) in order at least to allow said movable spray head (12) to be refilled with product, a miniature electric pump (24), known as the transfer pump, being powered by an electrical power supply means (140) and controlled by control means (142) and being interposed between the first and second reservoirs (16, 20) to allow product to be conveyed through the coupling means (22), characterized in that the coupling means (22) comprise complementary two-way (34, 36) coupling elements (30, 32), said ways (34, 36) comprising on the one hand a first way (34) which is capable of connecting to the first reservoir (16) a part of the second reservoir (20) which is positioned below a second associated product level (N2) for the second reservoir (20) and, on the other hand, a second way (36) which is capable of connecting to the second reservoir (20) a duct (38) known as the overflow and/or vent duct, which opens above a first associated product level (N1) for the first reservoir (16).

2. The device as claimed in claim 1, characterized in that the coupling elements (30, 32) are able to move between a closed first configuration associated with the removal of the movable spray head (12), in which configuration the two ways (34, 36) are simultaneously closed, and an open second configuration associated with the coupling of the movable spray head (12) and of the base (14), in which configuration the two ways (34, 36) are simultaneously open.

3. The device (10) as claimed in claim 1, characterized in that each way (34, 36) can be selectively opened or closed by associated electrically operated valves.

4. The device (10) as claimed in claim 2, characterized in that the coupling elements (30, 32) comprise:

a female member (30), borne by the movable spray head (12), and into an internal bore (40) of which there opens at least one radial end (42) of a first duct (44) of the spray head (12), associated with the first way (34), which is connected to the first reservoir (16) and a radial end (46) of a second duct (48) of the spray head (12), associated with the second, overflow, way (36), which is connected to the first reservoir (16) above the first associated level (N1) for the first reservoir (16), said female member (30) comprising at least one introductory opening (50) communicating with its bore (40), a substantially cylindrical intermediate spool (52) which is slideably mounted and is elastically returned by a return spring (53) in the bore (40) of the female member (30), said spool (52) being able to move between a rest position to which it is returned elastically in the bore (40) of the female member (30) and in which it stops off the ends (42, 46) of the first and second ducts (44, 48) of the spray head (12), and a coupling position in which the spool (52) is urged against the action of the return spring (53) to uncover the ends (42, 46) of the first and second ducts (44, 48) of the spray head, a substantially cylindrical male member (32) of a diameter at most equal to that of the introductory opening (50), through which there passes a first base duct (54) which is connected to the second reservoir (20) below a second associated level (N2) for the second reservoir (20) and a second base duct (56) which is connected to the second reservoir (20), the ends (58, 60) of which open radially at the periphery of said male member (32), said male member (32) being able to be introduced into the opening (50) of the female member (30) in order to urge the spool (52) against the action of the return spring (53) in order to uncover the ends (42, 46) of the first and second ducts (44, 48) of the spray head (12) opening into the bore (50) and then in order to make the radial ends of the first and second base ducts (54, 56) open on to the radial ends (58, 60) of the first and second ducts (44, 48) of the spray head (12) in order to open the two ways (34, 36).

5. The device (10) as claimed in claim 4, characterized in that the female member has the shape of a tubular sleeve (30) which comprises:

a first internal portion (62) of high diameter in which the tubular spool (52) is elastically returned by a return spring (53) which is housed in the spool (52) and which bears against a transverse end wall (64) of the sleeve (30), a second internal portion (66) of smaller diameter, which with the first portion (62) delimits a shoulder face (68) against which an annular flange (70) of the tubular spool (52) is intended to abut.

6. The device as claimed in claim 2, characterized in that the coupling elements (22) comprise:

a female member (30), borne by the movable spray head (12), into an internal bore of which there open at least a radial end (42) of a first duct (44) of the spray head (12), associated with the first way (34), which is connected to the first reservoir (16) and a radial end (46) of a second duct (48) of the spray head (12), associated with the second, overflow, way (36), which is connected to the first reservoir (16) above the first associated level (N1) for the first reservoir (16), said female member (30) comprising at least one introductory opening (50) communicating with its bore (40), a substantially cylindrical intermediate spool (52) which is slideably mounted and elastically returned in the bore (40) of the female member (30), said spool (52) having, passing substantially longitudinally through it, first and second intermediate ducts (72, 74) each having ends (76, 78) known as internal ends, opening radially at one end of the spool (52) into the internal bore (40) of the female member (30), and external ends (82, 84) opening axially at the opposite end (86) of the spool (52) into a free transverse face (88) of said spool (52), said spool (52) being able to move between a rest position, to which it is elastically returned by a spring (52) in the bore (40) of the female member (30), in which position it stops off the radial ends (42, 44) of the first and second ducts (44, 48) of the spray head (12), and a coupling position in which the spool (52) is urged against the action of the return spring (53) in order to uncover the radial ends (42, 46) of the first and second ducts (44, 48) of the spray head (12) and to allow the radial internal ends (76, 78) of the first and second intermediate ducts to coincide with the radial ends (42, 46) of the first and second ducts (44, 48) of the spray head (12), a substantially cylindrical male member (32) of a diameter at most equal to that of the introductory opening (50), through which there passes a first axial base duct (54) which is connected to the second reservoir (20) below a second associated level (N2) for the second reservoir (20) and a second axial base duct (56) which is connected to the second reservoir (20), the axial ends (58, 60) of which open into a free transverse face (90) of said male member (32), said male member (32) being able to be introduced into the opening (50) of the female member (30) in such a way that the transverse face (90) of the male member (32) acts upon the transverse face (88) of the spool (52) in order to urge the spool (52) against the action of the return spring (53) and, at the same time, in order to cause the ends of the first and second base ducts (54, 56) to open on to the external ends of the first and second ducts (72, 74) of the spool (52) in order to open the two ways (34, 36).

7. The device (10) as claimed in claim 6, characterized in that the female member has the form of a tubular sleeve (30) which comprises:

a first internal portion (62) of small diameter, in which a first portion (92) of the spool (52) comprising the internal ends (76, 78) of the first and second intermediate ducts is slideably mounted, a second internal portion (63) of high diameter in which an annular flange (94) of the tubular spool (52) is elastically returned by a return spring (53) which is housed around the spool (52) and which bears against a shoulder face (64) which is delimited by the first and second internal portions (62, 63) of the sleeve, a third internal portion (66) of small diameter, which with the second portion (62) delimits a shoulder face (68) against which the annular flange (94) of the tubular spool is intended to abut.

8. The device (10) as claimed in claim 5, characterized in that the sleeve (30) forming the female member extends into the first reservoir (16), and in that the first internal portion (62) comprises a radial drilling (44) which opens into said first reservoir (16) or alternatively which communicates with the pump (24) connected to the reservoir (16), and which constitutes the first duct (44) of the spray head (12) associated with the first way (34), and an internal axial counterbore (48) communicating with a drilling (94) which is formed in a transverse end wall (96) of the sleeve (30) and which communicates with a tube (38) opening above the first associated level (N1) for the first reservoir, to form the second duct (48) of the spray head, associated with the second, overflow, way (36).

9. The device (10) as claimed in claim 4, characterized in that the fixed base comprises a housing (98) that complements at least part (100) of the spray head, the complementary two-way coupling elements (320, 32) being interposed between a wall (102) of the spray head and the end wall (104) of the housing (98) of the fixed base (14).

10. The device as claimed in claim 2, characterized in that the coupling elements (22) comprise:

a female member (30), borne by an upper transverse wall (106) of the movable spray head (12), and into a substantially vertical internal bore (40) of which there open at least one radial end (42) of a first duct (44) of the spray head (12), associated with the first way (34), which is connected to the first reservoir (16) and an axial end (46) of a second duct (48) of the spray head, associated with the second, vent, way (36), which is connected to the first reservoir (16) above the first associated level (N1) for the first reservoir (16) and one end (47) of a third duct (49) of the spray head (12) which is associated with the second, vent, way (36) and which is in communication with the open air, said female member (30) comprising at least one introductory opening (50) communicating with its bore (40), a substantially cylindrical intermediate spool (52) which is slideably mounted and elastically returned in the bore (40) of the female member (30), said spool (52) having, passing substantially longitudinally through it, a first intermediate duct (72) having an end (76), known as the internal end, opening radially at one end (80) of the spool (52) into the internal bore (40) of the female member (30), and an end known as the external end (82) opening radially at the opposite end (86) of the spool (52) into a free transverse face (88) of said spool (52), said spool (52) having, passing substantially longitudinally through it, a second intermediate duct (74) comprising an end (78), known as the internal end, which opens axially at one end (80) of the spool into the internal bore (40) of the female member and which can be stopped off by a float (108) housed in the bore (40) of the female member, and a so-called intermediate end (84) opening radially into an intermediate part (110) of said spool (52), said spool (52) being able to move between a rest position to which it is elastically returned in the bore (40) of the female member (30) by the return spring (53) and in which it stops off the internal end (42) of the first duct (44) of the spray head associated with the first way (34) and the end (47) of the third duct (49) of the spray head associated with the second, vent, way (36) and a coupling position in which the spool (52) is urged against the action of the return spring (53) to allow the internal end (76) of the first intermediate duct (72) and the intermediate end (84) of the second intermediate duct (74) to coincide with the ends of the first and third ducts (44, 49) of the spray head (12), a substantially cylindrical male member (32) of a diameter at most equal to that of the introductory opening (50), through which there passes an axial base duct (54) which is connected to the second reservoir (20) below a second associated level (N2) for the second reservoir (20), the axial end (58) of which opens into a free transverse face (90) of said male member (32), said male member being able to be introduced into the opening (50) of the female member (30) so that the transverse face (90) of the male member (32) acts upon the transverse face (88) of the spool (52) in order to urge the spool (52) against the action of the return spring (53) and at the same time cause the end (58) of the first base duct (54) to open on to the external end (82) of the first duct (72) of the spool (52) in order to open the two ways (34, 36).

11. The device (10) as claimed in claim 10, characterized in that the female member (30) comprises:

an internal sleeve (112) in which the tubular spool (52) is returned elastically by a return spring (53) which bears against a transverse end wall (116) of the female member (30) and in which the float (108) is housed coaxially with said spring (53), an external sleeve (118), coaxial with the internal sleeve (112), the counterbores (120, 122) of which delimit with the internal sleeve (112) the first and third ducts (44, 49) of the spray head (12) and which comprises the transverse end wall (116) of the female member (30), a lid (124) which with the internal and external sleeves (112, 118) delimits a shoulder face (126) against which a shoulder face (128) of the tubular spool (52) is intended to abut and which comprises a drilling (50) forming the introductory opening intended to allow the passage of a reduced-diameter second portion (66) of the spool the free end of which constitutes the transverse face (88) of the spool (52) on which the transverse face of the male member (90) can act.

12. The device (10) as claimed in claim 11, characterized in that at least part of the internal (112) and external (118) sleeves extends into the first reservoir (16), said part comprising a radial drilling which opens into said first reservoir (16) or alternatively which communicates with the pump (24) connected to the reservoir (16) and which constitutes the first duct (44) of the spray head (12) associated with the first way (34), and said part comprising an axial drilling which is formed in a transverse end wall (116) of the external sleeve (118) and which communicates with the first reservoir (16) to form the second duct (48) of the spray head (12), associated with the second, vent, way (36).

13. The device (10) as claimed in claim 10, characterized in that the female member (30) is borne by a horizontal upper wall (132) of the movable spray head (12).

14. The device (10) as claimed in claim 4, characterized in that the spray head (12) comprises a spray pump (134) housed in a neck (136) of the first reservoir (16) and in that the female member (30) is housed in said neck (136) in a support (137) that is common to both the pump (134) and the female member (30).

15. The device (10) as claimed in claim 1, characterized in that the transfer pump (24) is a miniature pump of piezoelectric type.

16. The device (10) as claimed in claim 15, characterized in that the electric transfer pump (24) is housed in a first casing (26) of the movable spray head (12).

17. The device (10) as claimed in claim 1, characterized in that the electric transfer pump (24) is housed in a second casing (28) of the fixed base (14).

18. The device (10) as claimed in claim 14, characterized in that the electrical power supply means (140) comprises a cell, notably a miniature cell of the lithium cell type.

19. The device (10) as claimed in claim 14, characterized in that the electric power supply means (140) comprises an accumulator battery that can be recharged by means of a source of electrical power.

20. The packaging device (10) as claimed in claim 19, characterized in that the electric power supply means (140) is autonomous and notably comprises a photovoltaic panel or alternatively a manual generator of electrical current of the dynamo type.

21. The packaging device (10) as claimed in claim 19, characterized in that the accumulator battery (140) can be connected to an electrical network directly or via a transformer, notably to a domestic AC mains network via a plug and/or a dedicated base station, or alternatively can be connected to a motor vehicle on-board DC electric network via an outlet of the cigarette lighter type or alternatively to a personal computer serial peripheral DC power supply circuit via a so-called "USB" serial connector.

22. The packaging device (10) as claimed in claim 1, characterized in that the control means (142) comprises a switch (162, 164, 165, 166, 167) that controls the electrical power supply means (140).

23. The packaging device (10) as claimed in claim 1, characterized in that the control means (142) comprises an electronic circuit (168) that forms a switch.

24. The device (10) as claimed in claim 23, characterized in that the triggering of the electronic circuit (168) that forms a switch is brought about by the stopping-off of a photoelectric cell (170).

25. The device (10) as claimed in claim 23, characterized in that the triggering of the electronic circuit (168) that forms a switch is brought about by the coupling of the complementary two-way coupling elements (30, 32).

26. The device (10) as claimed in claim 1, characterized in that the spray head (12) or alternatively the base (14) comprises a casing (26, 28) housing the miniature transfer pump (24), the electrical power supply means (140) for said pump, and a means (142) of controlling said pump.

27. The packaging device (10) as claimed in claim 26, characterized in that the casing (26, 28) consists of a cap fitted over the associated reservoir (16, 20).

28. The device (10) as claimed in claim 26, characterized in that the pump (24) is borne by an intermediate element secured to the casing (26, 28).

29. The device as claimed in claim 26, characterized in that the pump (24) is fixed to an internal wall of the casing (26, 28).

30. The device (10) as claimed in claim 15, characterized in that the miniature pump (24) of piezoelectric type comprises at least one variable-volume chamber (150) to which the product is admitted via a first membrane (158) that forms a one-way valve and from which the product is ejected via a second membrane (160) that forms a one-way valve, the variable-volume chamber (150) comprising at least one fixed wall (152) and one moving membrane (154) capable of being moved by a piezoelectric actuator (156) in order to cause the volume of the chamber (150) to vary.

31. The device (10) as claimed in claim 1, characterized in that the movable spray head (12) comprises a miniature electric spray pump, notably of piezoelectric type, interposed between the first reservoir (16) and the outlet member (18), which is powered by an electrical power supply means for the movable spray head and which is controlled via control means.

32. The device (10) as claimed in claim 31, characterized in that the electrical power supply means for the spray pump comprises a rechargeable accumulator battery which can be connected via the coupling means (30, 32) to the source of electrical power used for recharging the rechargeable accumulator battery (140) of the base (14).

* * * * *